US011542959B2

(12) United States Patent
Findeisen et al.

(10) Patent No.: US 11,542,959 B2
(45) Date of Patent: Jan. 3, 2023

(54) MOTOR VEHICLE PUMP ARRANGEMENT AND MOUNTING ARRANGEMENT FOR A MOTOR VEHICLE PUMP ARRANGEMENT

(71) Applicant: PIERBURG PUMP TECHNOLOGY GMBH, Neuss (DE)

(72) Inventors: Alexander Findeisen, Doebeln (DE); Rene Patzner, Chemnitz (DE); Wolfgang Zacher, Doebeln (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 17/287,524

(22) PCT Filed: Oct. 25, 2018

(86) PCT No.: PCT/EP2018/079316
§ 371 (c)(1),
(2) Date: Apr. 22, 2021

(87) PCT Pub. No.: WO2020/083496
PCT Pub. Date: Apr. 30, 2020

(65) Prior Publication Data

US 2021/0388852 A1 Dec. 16, 2021

(51) Int. Cl.
*F04D 29/60* (2006.01)
*F04D 29/40* (2006.01)
(Continued)

(52) U.S. Cl.
CPC ..... *F04D 29/605* (2013.01); *F04D 29/406* (2013.01); *F04D 29/669* (2013.01); *F01P 5/10* (2013.01)

(58) Field of Classification Search
CPC .. F05D 2250/182; F04D 29/40; F04D 29/406; F04D 29/42; F04D 29/426;
(Continued)

(56) References Cited

U.S. PATENT DOCUMENTS 5,470,207 A * 11/1995 Shockey ..... F01C 21/007 417/313
2002/0015647 A1 2/2002 Nakagaki et al.
(Continued)

FOREIGN PATENT DOCUMENTS

CN 103085725 A 5/2013
CN 103155371 A 6/2013
(Continued)

OTHER PUBLICATIONS

Prospector website, plastics.ulprospector.com/properties/ISO48 (Year: 2014).*
(Continued)

*Primary Examiner* — J. Todd Newton
*Assistant Examiner* — Brian O Peters
(74) *Attorney, Agent, or Firm* — Norman B. Thot

(57) ABSTRACT

A motor vehicle pump arrangement includes a pumping unit and a mounting arrangement. The pumping unit has a substantially cylindrical pumping unit housing and at least one support protrusion which radially protrudes from the pumping unit housing. The mounting arrangement mounts the pumping unit to a motor vehicle mounting structure corresponding thereto. The mounting arrangement has a ring-shaped pump support body. The pump support body radially surrounds and supports the pumping unit and is attachable to the motor vehicle mounting structure. An axial side of the pump support body includes a castellated structure having axially extending merlons and protrusion receptacles. One protrusion receptacle is arranged between two adjacent merlons. The support protrusion engages with at least one of the protrusion receptacles.

9 Claims, 3 Drawing Sheets

(51) Int. Cl.
*F04D 29/66* (2006.01)
*F01P 5/10* (2006.01)

(58) Field of Classification Search
CPC ..... F04D 29/60; F04D 29/605; F04D 29/606; F04D 29/62; F04D 29/628; F04D 29/669; F01P 5/10
See application file for complete search history.

(56) References Cited

U.S. PATENT DOCUMENTS

| | | | |
|---|---|---|---|
| 2013/0075572 | A1 | 3/2013 | Matsumoto et al. |
| 2013/0111721 | A1 | 5/2013 | Mahfoudh et al. |
| 2013/0221786 | A1 | 8/2013 | Truillet et al. |
| 2013/0251557 | A1 | 9/2013 | Ota et al. |
| 2014/0234141 | A1 | 8/2014 | Hoshi et al. |
| 2017/0343153 | A1 | 11/2017 | Yilmaz et al. |

FOREIGN PATENT DOCUMENTS

| | | | |
|---|---|---|---|
| DE | 10 2016 209 204 | A1 | 11/2017 |
| EP | 1 584 821 | A1 | 10/2005 |
| JP | S60-171998 | U | 11/1985 |
| JP | S63-2899 | U | 1/1988 |
| JP | H09-126198 | A | 5/1997 |
| JP | 2008-121522 | A | 5/2008 |
| JP | 2011-27203 | A | 2/2011 |
| JP | 2013-224652 | A | 10/2013 |
| WO | WO 2007/118558 | A1 | 10/2007 |
| WO | WO2011/158538 | A1 | 12/2011 |
| WO | WO2012/108475 | A1 | 8/2012 |

OTHER PUBLICATIONS

Google web search publication date of Prospector website (Year: 2014).*
JP2011027203 machine translation (Year: 2011).*

* cited by examiner

MOTOR VEHICLE PUMP ARRANGEMENT AND MOUNTING ARRANGEMENT FOR A MOTOR VEHICLE PUMP ARRANGEMENT

CROSS REFERENCE TO PRIOR APPLICATIONS

This application is a U.S. National Phase application under 35 U.S.C. § 371 of International Application No. PCT/EP2018/079316, filed on Oct. 25, 2018. The International Application was published in English on Apr. 30, 2020 as WO 2020/083496 A1 under PCT Article 21(2).

FIELD

The present invention is directed to a motor vehicle pump arrangement, in particular to motor vehicle pump arrangement with a mounting arrangement for mounting the pumping unit to a corresponding motor vehicle mounting structure. The present invention is also directed to a mounting arrangement for a such a motor vehicle pump arrangement.

BACKGROUND

Such a pump arrangement comprises a pumping unit, for example, an electric pumping unit, for circulating a fluid within a motor vehicle fluid circuit. The pump arrangement also comprises a mounting arrangement for mounting the pumping unit to a corresponding motor vehicle mounting structure. The mounting arrangement is provided with a pump support body which is attachable to the motor vehicle mounting structure and which supports the pumping unit. The decoupling body is typically ring-shaped and radially surrounds as well as supports the pumping unit. Since the mounting site and mounting orientation of the pump arrangement within the motor vehicle is typically different for different motor vehicles, the pump arrangement should be adaptable to different mounting sites and in particular to different mounting orientations in a simple way.

Such a pump arrangement is, for example, described in DE 10 2016 209 204 A1. The ring opening of the pump support body is here press-fitted to a corresponding peripheral surface of a pumping unit housing so that the pumping unit is supported by the decoupling body in a force-locked manner. Since the pump support body must be relatively flexible to provide an efficient vibrational decoupling, the force-locked connection can only support relatively limited forces in an axial as well as in a circumferential direction. Only a relatively low torque is therefore required to rotate the pumping unit within the pump support body. The disclosed pump arrangement therefore fails to provide a robust and reliable rotational orientation of the pumping unit. The pumping unit housing is also provided with radially protruding support protrusions which are in axial contact with the decoupling body to provide an additional form-locked axial support of the pumping unit at the decoupling body. The support protrusions are arranged on both axial sides of the decoupling body to provide a support in both axial directions.

Because of the press-fitted attachment of the pumping unit to the pump support body, the pumping unit can be mounted with different rotational orientations with respect to the pump support body and thereby with respect to the motor vehicle mounting structure in a simple manner. The pump support body must, however, be mounted to the pumping unit during the assembly of the pumping unit housing and, in particular, cannot be mounted to a completely assembled pumping unit. The pump support body mounting step must therefore be integrated into the pumping unit assembly process which results in a complex assembly of the pump arrangement.

The prior art also describes mounting the pump support body to a completely assembled pumping unit, wherein the pump support body is fixed to the pumping unit by screw joints or by an adhesive bonding. However, these fixations methods require additional fixation elements and/or a complex mounting process to attach the decoupling body to the pumping unit. Screw joints in particular also do not allow a mounting of the pumping unit with different rotational orientations without structurally adapting the pumping unit and/or the pump support body.

SUMMARY

An aspect of the present invention is to provide a motor vehicle pump arrangement which allows for a reliable mounting of the pumping unit with different rotational orientations with respect to the motor vehicle mounting structure and which can be assembled in a simple manner.

In an embodiment, the present invention provides a motor vehicle pump arrangement which includes a pumping unit and a mounting arrangement. The pumping unit comprises a pumping unit housing which is substantially cylindrical, and at least one support protrusion which is arranged to radially protrude from the pumping unit housing. The mounting arrangement is configured to mount the pumping unit to a motor vehicle mounting structure corresponding thereto. The mounting arrangement comprises a pump support body having a ring-shape. The pump support body is configured to radially surround the pumping unit, to support the pumping unit, and to be attachable to the motor vehicle mounting structure. An axial side of the pump support body comprises a castellated structure which comprises a plurality of axially extending merlons and a plurality of protrusion receptacles. A respective one of the plurality of protrusion receptacles is arranged between two of the plurality of axially extending merlons which are adjacent to each other. The at least one support protrusion of the pumping unit housing is configured to engage with at least one of the plurality of protrusion receptacles.

BRIEF DESCRIPTION OF THE DRAWINGS

The present invention is described in greater detail below on the basis of embodiments and of the drawings in which.

DETAILED DESCRIPTION

Figure 1:
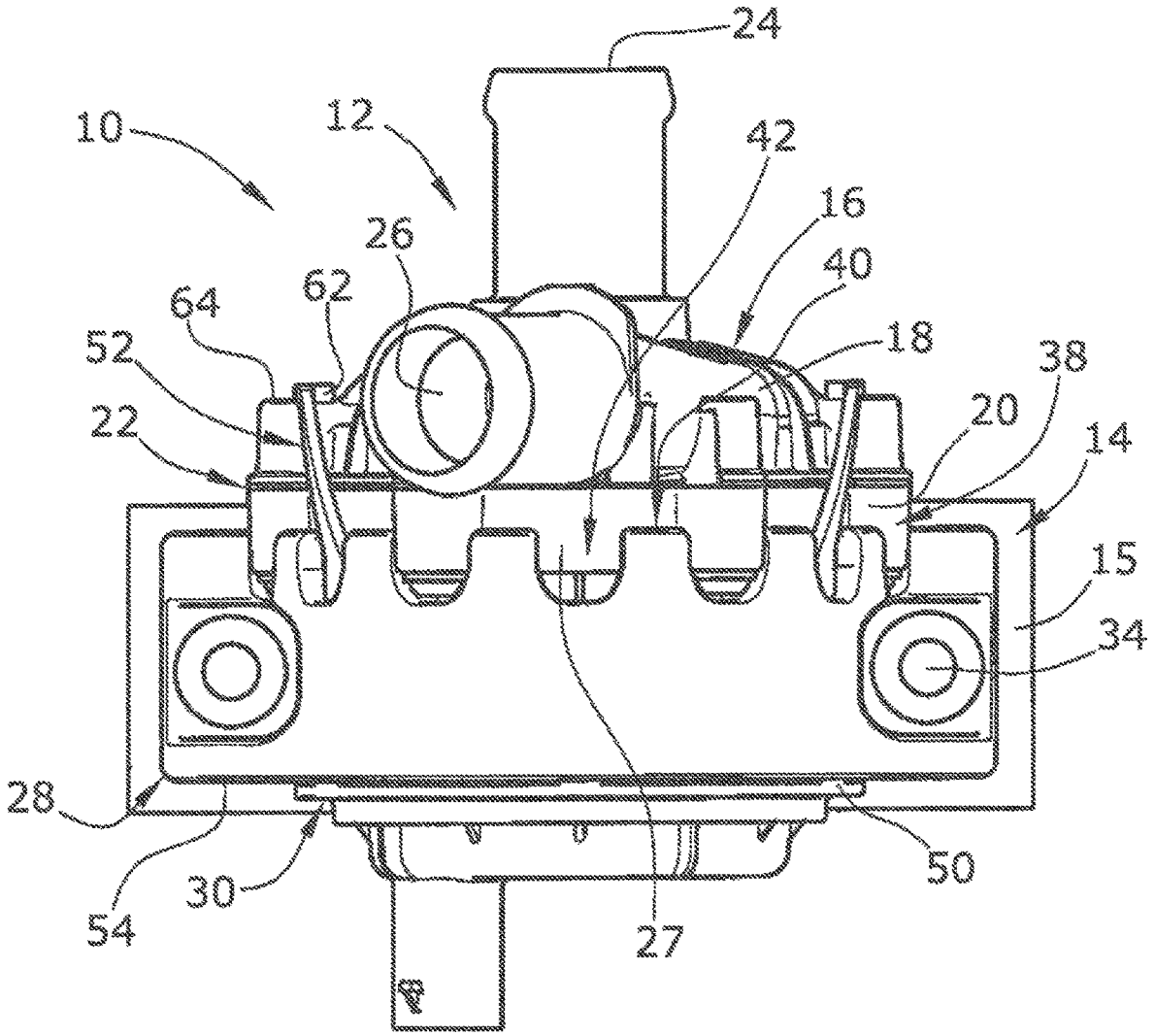
FIG. 1 shows a lateral view of a motor vehicle pump arrangement according to the present invention.
Figure 2:
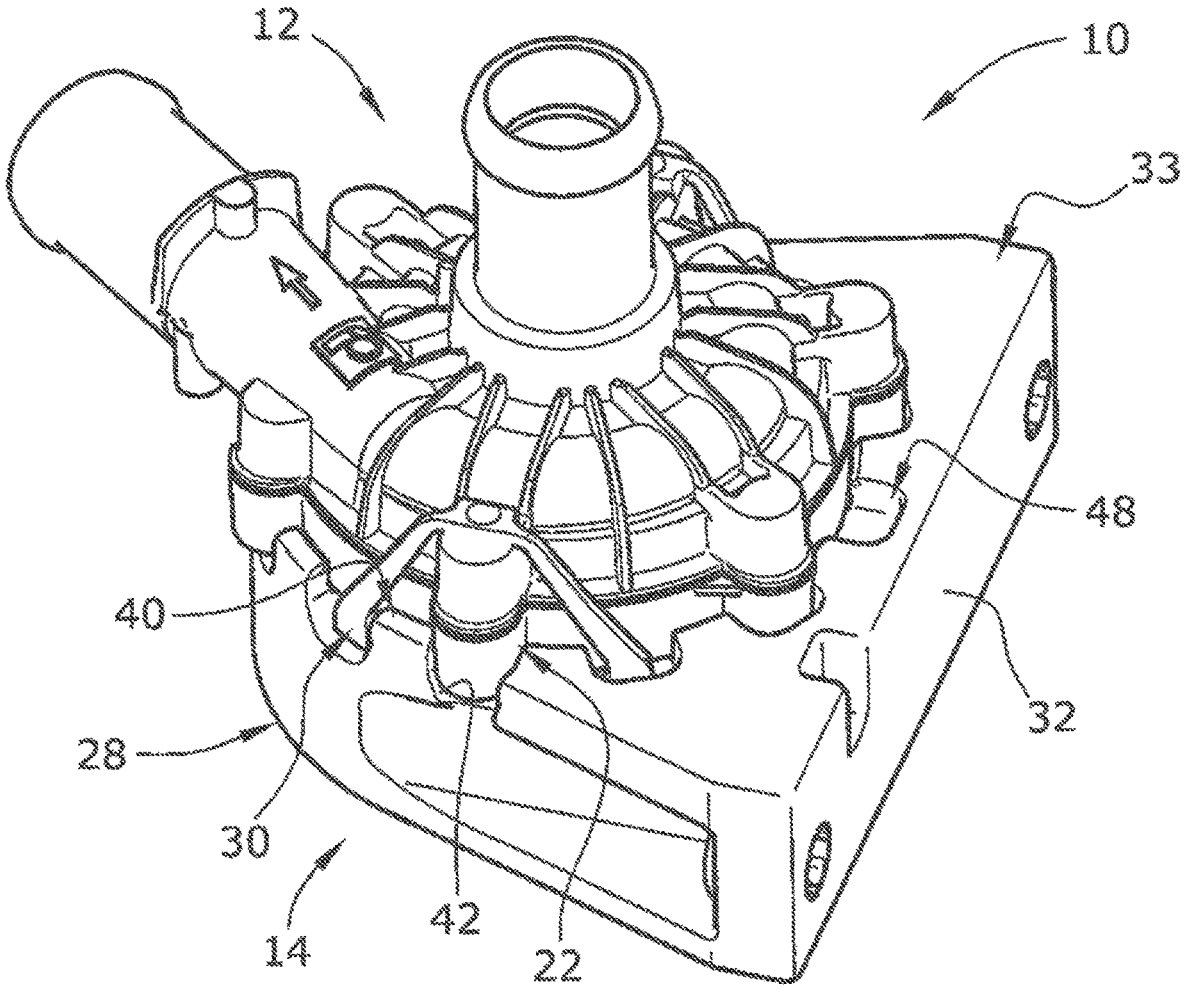
FIG. 2 shows a perspective view of the motor vehicle pump arrangement of FIG. 1.
Figure 3:
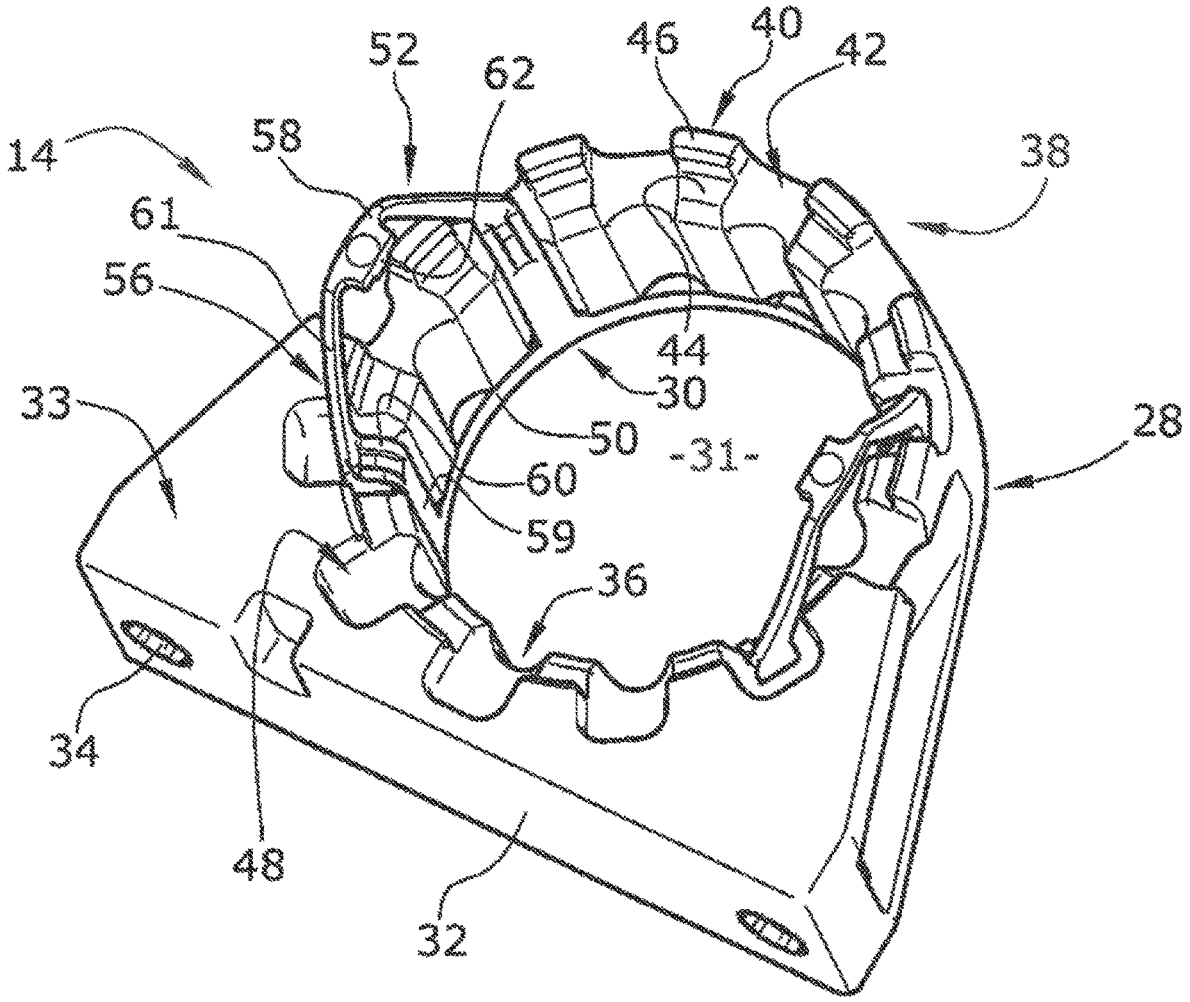
FIG. 3 shows a perspective view of a mounting arrangement of the motor vehicle pump arrangement of FIG. 1.

The motor vehicle pump arrangement according to the present invention is provided with a pumping unit for circulating a working fluid within a motor vehicle fluid circuit. The pumping unit can, for example, be electrically driven by an electric motor and is not mechanically driven by a motor vehicle engine. The pumping unit can in particular be an electric coolant pump for circulating a coolant within a motor vehicle coolant circuit. In contrast to a mechanically driven pumping unit, the mounting site of an electrically driven pumping unit is relatively independently selectable. Because of the missing mechanical coupling with the engine, vibrations are transferred into the electrically driven pumping unit only via the mounting arrangement.

The pumping unit comprises a substantially cylindrical pumping unit housing with at least one support protrusion which radially protrudes from the pumping unit housing. The support protrusion can, for example, be provided integrally with the pumping unit housing, but can alternatively be provided as a separate body which is attached to the pumping unit housing. The support protrusion can, for example, be arranged at a lateral surface of the cylindrical pumping unit housing, but can alternatively be arranged at an axial end face of the pumping unit housing. The support protrusion in any case radially protrudes from the pumping unit housing, i.e., the support protrusion radially extends beyond the radial extent of the cylindrical pumping unit housing. The pumping unit can, for example, be provided with a plurality of support protrusions which are disposed along the circumference of the pumping unit with a uniform angular distance.

The motor vehicle pump arrangement according to the present invention is also provided with a mounting arrangement for mounting the pumping unit to a motor vehicle mounting structure. The mounting structure is directly attached to or defined by the motor vehicle frame or, alternatively, is attached to or defined by a motor vehicle component, for example, as a motor vehicle engine, which is attached to the motor vehicle frame. The mounting arrangement comprises a ring-shaped pump support body which extends substantially in a transversal pumping unit plane. The pump support body radially surrounds and supports the pumping unit and is attachable to the motor vehicle mounting structure. The pump support body can, for example, radially surround the electric motor of the electric pumping unit so that the center of mass of the pumping unit is located within the pump support body. The pumping unit is supported at the motor vehicle mounting structure only via the pump support body and is in particular not in direct contact with the motor vehicle mounting structure, the motor vehicle frame, or the motor vehicle engine. The pump support body is provided with a circular ring opening which corresponds with the shape of the pumping unit section which is surrounded by the pump support body so that the pumping unit is radially supported by the pump support body substantially along the entire circumference.

According to the present invention, an axial side of the pump support body is provided with a castellated structure comprising several axially extending merlons. The merlons of the castellated structure can, for example, be disposed along the circumference of the pump support body with a uniform angular distance and define several protrusion receptacles between them. In the mounted state of the pump arrangement, the at least one support protrusion of the pumping unit housing engages at least one protrusion receptacle so that the pumping unit cannot rotate within the pump support body. The pumping unit is as a result provided with a reliably defined and stable rotational position with respect to the pump support body and, as a result, with respect to the motor vehicle mounting structure. Since the pump support body is provided with a plurality of protrusion receptacles which are disposed along its circumference with a uniform angular distance, the pumping unit can be reliably mounted with several different defined rotational orientations with respect to the pump support body in simple manner which in particular does not require any structural adaptation of the pumping unit and/or of the mounting arrangement.

In an embodiment of the present invention, the pump support body can, for example, be a vibration-decoupling body which is made of a relatively soft and elastic material. The vibration-decoupling body can, for example, be made of rubber, silicone, SEBS, EPDM, or any other elastomer and is provided with a hardness in in the range of 30 to 70 IRHD, for example, with a hardness in the range of 30 to 40 IRHD. The vibration-decoupling body can efficiently compensate vibrations so that the vibrations are not transferred, or are only transferred in a significantly suppressed manner, from the motor vehicle mounting structure into the pumping unit or vice versa. The suppressed vibration transfer into the pumping unit minimizes the failure probability of the pumping unit and improves the pumping unit's lifetime. The suppressed vibration transfer from the pumping unit into the motor vehicle frame in particular minimizes the passenger compartment noise of the motor vehicle.

The number of protrusion receptacles can, for example, be higher than the number of support protrusions. The higher the number of protrusion receptacles, the higher the number of different rotational mounting orientations of the pumping unit within the pump support body. This provides a highly adaptable motor vehicle pump arrangement.

In an embodiment of the present invention, the pumping unit can, for example, be provided with at least two support protrusions which are arranged along the circumference of the pumping unit with a uniform angular distance. The support protrusions are arranged so that the angular distance between circumferentially adjacent support protrusions is equal to or an integral multiple of the angular distance between adjacent protrusion receptacles. This allows for a mounting the pumping unit within the pump support body with several different rotational orientations, wherein the number of mounting orientations is defined by the quotient of 360° and the angular distance between two adjacent protrusion receptacles.

Each merlon of the castellated structure can, for example, comprise a substantially transversal pump support pedestal as well as a rotation-locking tongue which axially projects from the pump support pedestal. The rotation-locking tongues of the merlons laterally enclose the support protrusions of the pumping unit at least partially so that the pumping unit is provided with a defined and stable rotational orientation with respect to the pump support body. The transversal pump support pedestals provide a relatively large axial support area for the pumping unit so that no additional axial support means must be provided at the pump support body.

In an embodiment of the present invention, the pump support body can, for example, be provided with a frame mount portion which defines a flange portion extending in a longitudinal pumping unit plane and which is attachable to the motor vehicle mounting structure. The flange portion can, for example, be provided with screw holes so that the pump support body can be attached to the motor vehicle mounting structure by a simple and robust screw joint. The flange portion provides a large contact area between the pump support body and the motor vehicle mounting structure and, as a result, provides a robust and reliable attachment of the motor vehicle pump arrangement to the motor vehicle mounting structure.

The frame mount portion must be relatively massive to provide a robust mounting of the pump support body to the motor vehicle mounting structure. The frame mount portion partially radially encloses the ring opening of the pump support body as a result. The frame mount portion can, for example, be provided with at least one protrusion pocket which circumferentially defines a protrusion receptacle. Depending on the circumferential extent of the frame mount portion, the frame mount portion is provided with a plurality of protrusion pockets which each circumferentially define a protrusion receptacle. This provides a circumferentially continuous and closed castellated structure. The radial extent of the protrusion pockets is provided so that the support protrusions of the pumping unit can completely engage the protrusion pocket.

The pumping unit housing comprises two housing bodies which are axially attached to each other by a screw joint. The screw sockets are typically located at the radial outside of the pump housing and radially protrude from the pump housing. The at least one support protrusion can, for example, be defined by a screw socket of the pumping unit housing so that the radially protruding screw sockets engage the protrusion receptacles of the pump support body. No additional protrusions must therefore be provided at the pumping unit to achieve a defined and stable rotational orientation of the pumping unit within the pump support body.

In an embodiment of the present invention, the mounting arrangement can, for example, comprises a clip retainer which is attached to the pump support body and which axially retains the pumping unit. The clip retainer can, for example, be made of thermoplastic, for example, of a glass-ball-reinforced polyamide, and is attached to the pump support body in a form-locked manner. The clip retainer allows for a simple assembly of the motor vehicle pump arrangement, wherein the clip retainer provides a reliable attachment of the pumping unit to the pump support body which does not require any complex fixation process and/or additional fixation elements.

The clip retainer can, for example, axially extend through a ring opening of the pump support body, wherein the radial inside of the ring opening is provided with retainer recesses into which the clip retainer engages. The clip retainer is as a result supported radially outwardly by the pump support body so that no additional support elements are required to provide a reliable attachment of the clip retainer to the pump support body. The clip retainer can, for example, be radially clamped between the radial inside of the pump support body and the radial outside of the pumping unit housing. The retainer recesses can be provided at an axial surface and/or at a radially inner surface of the pump support body. The engaged clip retainer is in any case circumferentially enclosed by the pump support body so that the clip retainer cannot rotate within the pump support body. The retainer recesses allow the retainer clip to be provided with a defined and stable rotational position with respect to the pump support body which does not require any separate positioning elements.

An embodiment of the present invention is described below under reference to the enclosed drawings.

The described motor vehicle pump arrangement 10 according to the present invention comprises an electric pumping unit 12 and a mounting arrangement 14 for mounting the pumping unit 12 to a corresponding motor vehicle mounting structure 15 which can, for example, be defined by a motor vehicle frame or by a motor vehicle engine.

The pumping unit 12 is provided with a substantially cylindrical pumping unit housing 16 which comprises a volute housing body 18, and a motor housing body 20. The volute housing body 18 and the motor housing body 20 are axially attached to each other by several screws which are arranged in corresponding screw sockets. The pumping unit housing 16 comprises several support protrusions 22 which radially protrude from the pumping unit housing 16. In the shown embodiment of the present invention, the support protrusions 22 are provided by the screw sockets. The pumping unit housing 16 is provided with a ring-shaped transversal support platform 27. The support protrusions 22 are located at the radial outside of the pumping unit housing 16 and radially protrude from the support platform 27. The pumping unit 12 is provided with an axial pump inlet 24 and with a radial pump outlet 26.

The mounting arrangement 14 comprises a substantially ring-shaped pump support body 28 and a clip retainer 30 which is attached to the pump support body 28 and which axially retains the pumping unit 12.

In the shown embodiment of the present invention, the pump support body 28 is a vibration-decoupling body which is made of a relatively soft and elastic material, in particular of rubber with a hardness in the range of 30 to 40 IRHD or INTERNATIONAL RUBBER HARDNESS DEGREES. The pump support body 28 is provided with a substantially circular ring opening 31 and radially surrounds and supports the pumping unit 12. The pump support body 28 in particular radially surrounds the motor housing body 20 containing the relatively heavy-weight electric motor (which is not shown in the drawings) of the pumping unit 12 so that a center of mass of the pumping unit 12 is located within the axial extent of the pump support body 28. The radial inside of the ring opening 31 of the pump support body 28 is provided with several retainer recesses 36 which are disposed along the inner circumference of the ring opening 31 with a uniform angular distance.

The axial top side of the pump support body 28 which faces the volute housing body 18 is provided with a castellated structure 38 comprising several axially extending merlons 40. The merlons 40 are disposed along the circumference of the ring opening with a uniform angular distance and define several protrusion receptacles 42 between them. The protrusion receptacles 42 are provided at the same circumferential positions as the retainer recesses 36 so that the protrusion receptacles 42 and the retainer recesses 36 merge with each other. Each merlon 40 is provided with a substantially L-shaped radial cross section and comprises a substantially transversal pump support pedestal 44 as well as a rotation-locking tongue 46 which axially projects from the pump support pedestal 44, in particular axially projecting from the radially outer rim region of the pump support pedestal 44.

The pump support body 28 is provided with a frame mount portion 33 which partially radially surrounds the ring opening 31 and which defines a flange portion 32 which extends substantially in a longitudinal pumping unit plane. The flange portion 32 is provided with two screw holes 34 so that the pump support body 28 is attachable to the motor vehicle mounting structure 15 via a screw joint. The frame mount portion 33 is provided with several protrusion pockets 48 which circumferentially define the protrusion receptacles 42 and, as a result, the merlons 40 within the extent of the frame mount portion 33.

In the shown embodiment of the present invention, the clip retainer 30 is made of a glass-ball-reinforced polyamide. The clip retainer 30 comprises a ring-shaped retainer frame 50 and two retainer arms 52 which axially project from the retainer frame 50 and which extend through the ring opening 31 of the pump support body 28. The retainer frame 50 radially surrounds the pumping unit 12, and is axially supported by a transversal bottom face 54 located at a volute-housing-body-remote axial bottom side of the pump support body 28.

Each retainer arm 52 is provided to be substantially U-shaped and comprises two substantially axially extending support legs 56 which are laterally connected by a substantially laterally extending connection leg 58. Each support leg 56 comprises three support leg sections: a first axial support leg section 59, a radially extending support section 60, and a second axial support leg section 61. The first axial support leg section 59 extends in an upward axial direction starting from the retainer frame 50. The support section 60 extends radially outwardly starting from a retainer-frame-remote axial end of the first axial support leg section 59. The second axial support leg section 61 extends in an upward axial direction starting from the radial outer end of the support section 60. The support section 60 is axially located approximately at a half axial height of the support leg 56. The support section 60 is in particular located axially spaced from the retainer frame 50. The connection leg 58 is attached to a retainer-frame-remote axial end of the second axial support leg section 61. Each retainer arm 52 is also provided with a snap element 62 which is provided at the radial inside of the connection leg 58 and which extends radially inwardly starting from the connection leg 58.

Each first axial support leg section 59 of the retainer arms 52 engages a corresponding retainer recess 36 of the pump support body 28 so that each first axial support leg section 59 is supported at the radial outside and at both lateral sides by the pump support body 28. Each support section 60 of the retainer arms 52 engages a corresponding protrusion receptacle 42 of the pump support body 28 so that each support section 60 is supported at the bottom axial side and at both lateral sides by the pump support body 28.

The clip retainer 30 is radially supported by the pump support body 28 via the first axial support leg sections 59. The clip retainer 30 is axially supported by the pump support body 28 in both axial directions, wherein the clip retainer 30 is supported in the downward axial direction via the support sections 60 and in the upward axial direction via the retainer frame 50. Because of the engagement of the support legs 56 with the retainer recesses 36 and the protrusion receptacles 42, the clip retainer 30 is also provided with a defined and stable rotational orientation with respect to the pump support body 28.

The pumping unit 12 is radially supported by the radial inside of the ring opening 31 of the pump support body 28, and is axially supported in the downward axial direction by the pump support pedestals 44 of the merlons 40. The snap elements 62 of the retainer arms 62 engage corresponding engagement steps 64 of the pumping units 12, wherein each engagement step 64 is defined by a topside surface of a support protrusion 22. The pumping unit 12 is thereby axially retained in the upward axial direction by the snap elements 62 of the retainer arms 52.

The support protrusions 22 of the pumping unit 12 engage corresponding protrusion receptacles 42 so that the support protrusions 22 are at least partially enclosed at both lateral sides by the rotation-locking tongues 46 of the two adjacent merlons 40. The pumping unit 12 is thereby provided with a defined and stable rotational orientation with respect to the pump support body 28.

The pump support body 28 is provided with a larger number of retainer recesses 36 and protrusion receptacles 42 compared to the number of support legs 56 of the retainer arms 52 as well as compared to the number of support protrusion 22 of the pumping unit 12. The angular distance between circumferentially adjacent support protrusions 22 as well as the angular distance between circumferentially adjacent first axial support leg sections 59 is an integral multiple of the angular distance between circumferentially adjacent protrusion receptacles 42. The pumping unit 12 and the clip retainer 30 can therefore be mounted to the pump support body 28 with several different defined and stable rotational orientations in a simple way and, in particular, without requiring any structural adaptations of the pump support body 28 and/or the pumping unit housing 16.

The present invention is not limited to embodiments described herein; reference should be had to the appended claims.

LIST OF REFERENCE NUMERALS

10 motor vehicle pump arrangement
12 pumping unit
14 mounting arrangement
15 motor vehicle mounting structure
16 pumping unit housing
18 volute housing body
20 motor housing body
22 support protrusions
24 pump inlet
26 pump outlet
27 support platform
28 pump support body
30 clip retainer
31 ring opening
32 flange portion
33 frame mount portion
34 screw holes
36 retainer recesses
38 castellated structure
40 merlons
42 protrusion receptacle
44 pump support pedestal
46 rotation-locking tongue
48 protrusion pocket
50 retainer frame
52 retainer arms
54 bottom face
56 support legs
58 connection leg
59 first axial support leg section
60 support section
61 second axial support leg section
62 snap element
64 engagement steps

What is claimed is:

1. A motor vehicle pump arrangement comprising:

a pumping unit which comprises a pumping unit housing which is substantially cylindrical, and at least one support protrusion which is arranged to radially protrude from the pumping unit housing; and a mounting arrangement which is configured to mount the pumping unit to a motor vehicle mounting structure corresponding thereto, the mounting arrangement comprising a pump support body having a ring-shape, the pump support body being configured to radially surround the pumping unit, to support the pumping unit, and to be attachable to the motor vehicle mounting structure, an axial side of the pump support body comprising a castellated structure which comprises a plurality of axially extending merlons and a plurality of protrusion receptacles, a respective one of the plurality of protrusion receptacles being arranged between two of the plurality of axially extending merlons which are adjacent to each other, wherein, the at least one support protrusion of the pumping unit housing is configured to engage with at least one of the plurality of protrusion receptacles, and a number of the plurality of protrusion receptacles is higher than a number of the at least one support protrusion.

2. The motor vehicle pump arrangement as recited in claim 1, wherein the pump support body is provided as a vibration-decoupling body which has a hardness of 30 to 70 IRHD.

3. The motor vehicle pump arrangement as recited in claim 1, wherein, the pumping unit comprises at least two of the at least one support protrusion, the at least two of the at least one support protrusion being arranged with a uniform angular distance along a circumference of the pumping unit, and the uniform angular distance between the at least two of the at least one support protrusion which are circumferentially adjacent to each other is equal to or an integral multiple of an angular distance between the plurality of protrusion receptacles which are adjacent to each other.

4. The motor vehicle pump arrangement as recited in claim 1, wherein each of the plurality of axially extending merlons of the castellated structure comprises a substantially transversal pump support pedestal and a rotation-locking tongue which is arranged to axially project from the substantially transversal pump support pedestal.

5. The motor vehicle pump arrangement as recited in claim 1, wherein the pump support body further comprises a frame mount portion which defines a flange portion, the flange portion being arranged to extend in a longitudinal pumping unit plane and which is attachable to the motor vehicle mounting structure.

6. The motor vehicle pump arrangement as recited in claim 5, wherein the frame mount portion comprises at least one protrusion pocket which circumferentially defines one of the plurality of protrusion receptacles.

7. The motor vehicle pump arrangement as recited in claim 1, wherein the mounting arrangement further comprises a clip retainer which is attached to the pump support body and which is configured to axially retain the pumping unit.

8. The motor vehicle pump arrangement as recited in claim 7, wherein, the pump support body further comprises a ring opening, the ring opening comprises a radial inside which comprises retainer recesses, and the clip retainer is further configured to extend through the ring opening of the pump support body and to engage the retainer recesses.

9. A mounting arrangement for a motor vehicle pump arrangement, the mounting arrangement being configured to mount a pumping unit to a motor vehicle mounting structure corresponding thereto, the mounting arrangement comprising:

a ring-shaped pump support body which is configured to radially surround the pumping unit, to support the pumping unit, and to be attachable to the motor vehicle mounting structure, an axial side of the ring-shaped pump support body comprising a castellated structure which comprises a plurality of axially extending merlons and a plurality of protrusion receptacles, a respective one of the plurality of protrusion receptacles being arranged between two of the plurality of axially extending merlons which are adjacent to each other.

* * * * *